US006186364B1

(12) United States Patent
Dobbs

(10) Patent No.: US 6,186,364 B1
(45) Date of Patent: Feb. 13, 2001

(54) DOSAGE CONTROL FOR DISPENSER WITH CHILD-RESISTANT FEATURE

(75) Inventor: Douglas B. Dobbs, Yorba Linda, CA (US)

(73) Assignee: Calmar Inc., City of Industry, CA (US)

( * ) Notice: Under 35 U.S.C. 154(b), the term of this patent shall be extended for 0 days.

(21) Appl. No.: 09/444,367

(22) Filed: Nov. 22, 1999

(51) Int. Cl.[7] ..... B67D 5/33
(52) U.S. Cl. ..... 222/153.13; 222/321.9
(58) Field of Search ..... 222/153.13, 321.9

(56) References Cited

U.S. PATENT DOCUMENTS

| | | | | |
|---|---|---|---|---|
| 3,678,884 | | 7/1972 | Robbins . | |
| 4,051,983 | | 10/1977 | Anderson . | |
| 4,565,302 | | 1/1986 | Pfeiffer et al. . | |
| 4,566,611 | * | 1/1986 | Sukopp | 222/153.13 |
| 5,277,334 | | 1/1994 | Malinconico . | |
| 5,335,823 | | 8/1994 | Fuchs et al. . | |
| 5,405,057 | * | 4/1995 | Moore | 222/321.9 |
| 5,725,128 | * | 3/1998 | Foster | 222/153.13 |
| 5,791,518 | | 8/1998 | Amann et al. . | |

* cited by examiner

*Primary Examiner*—Philippe Derakshani
(74) *Attorney, Agent, or Firm*—Dykema Gossett PLLC

(57) ABSTRACT

A manually actuated pump dispenser has a control ring mounted on the pump body for rotation about its central axis and engaging the pump plunger for controlling the number of plunger strokes and thereby the dosage of the dispenser for each cycle of revolution of the control ring, the plunger being releasably locked with the control ring against plunger reciprocation at the commencement and at the end of each cycle of revolution of the control ring to thereby render the same child-resistant.

11 Claims, 2 Drawing Sheets

FIG. 1
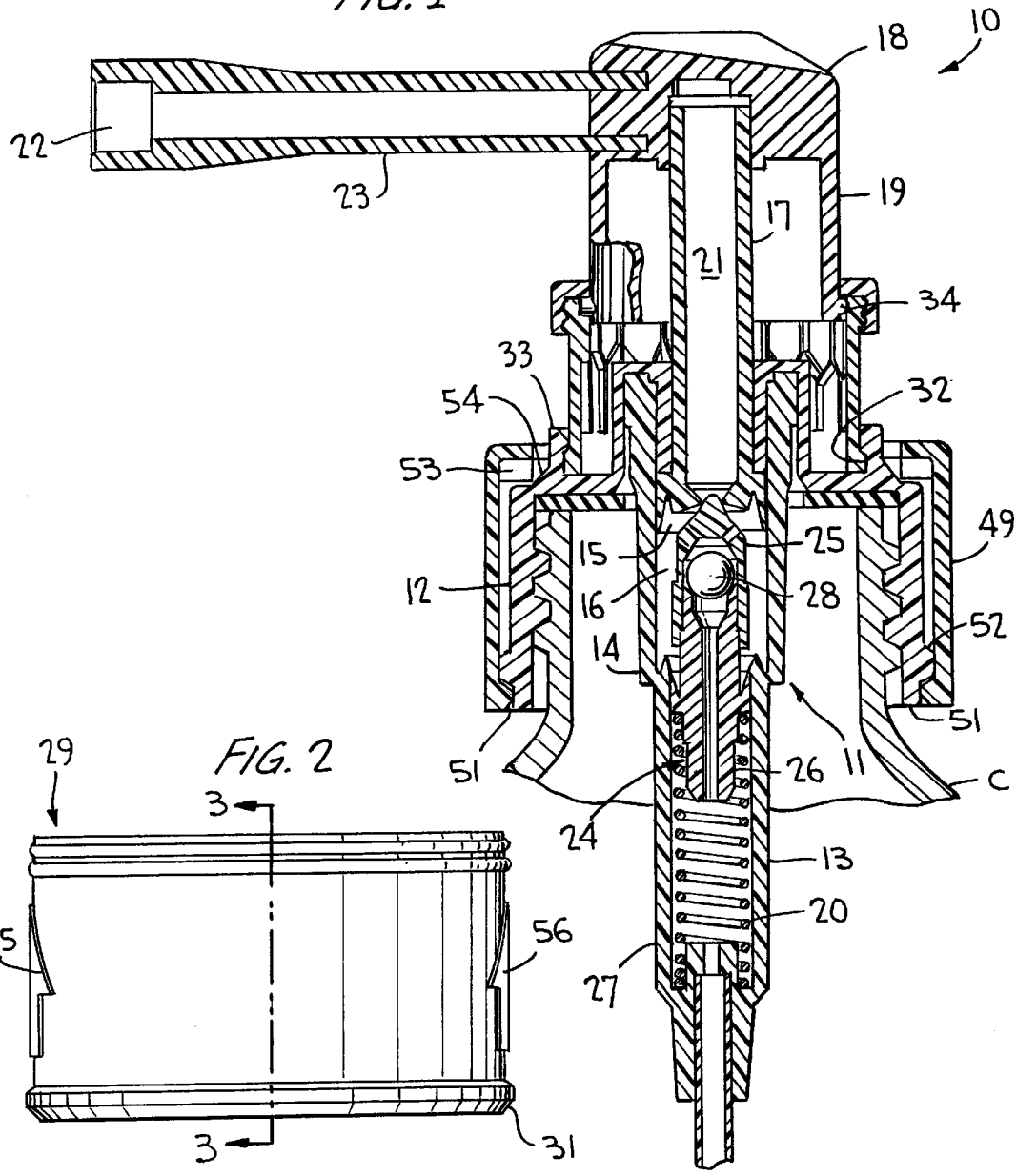
FIG. 2
FIG. 3
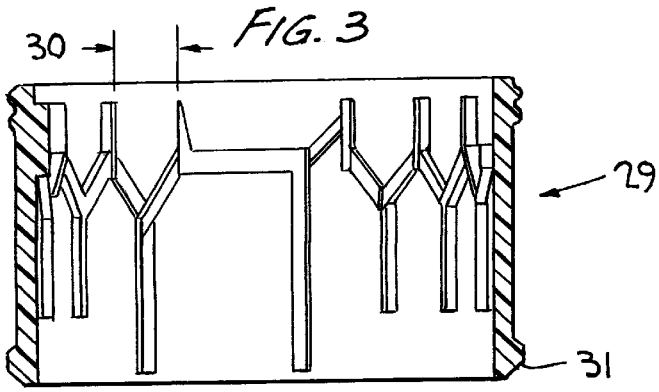

DOSAGE CONTROL FOR DISPENSER WITH CHILD-RESISTANT FEATURE

BACKGROUND OF THE INVENTION

This invention relates to a manually actuated pump dispenser which provides for a predetermined number of pump strokes for dosage control prior to automatically resetting after the final stroke. The pump plunger of the dispenser is locked against actuation in a condition prior to the first stroke and following the final stroke.

More particularly the dispenser according to the invention has a freely rotatable control ring engaging the plunger for controlling the number of plunger strokes and thereby the dosage during an unlocked condition of the pump for each revolution of the control ring. The control ring is coupled to the plunger in a manner for releaseably locking the plunger against reciprocation. The control ring and the plunger must be relatively rotated to unlock the ring thereby rendering the dispenser child-resistant.

U.S. Pat. No. 5,335,823 discloses a discharge apparatus for media of a random type in which a discharge process is performed with one or more discharge actuating means. The dispenser is so constructed that it can be moved backwards and forwards in one or more motion cycles in manual manner between one or more starting positions and one or more end positions. In one or more of such positions the discharge actuating means can be fixed by one or more catch systems at least within certain movement limits against movements in the actuating direction, and/or return direction in the catch system can be released again by one or more manual actuations.

U.S. Pat. No. 4,565,302 discloses an actuatable dosing mechanism with an actuating pusher for dispensing a measured quantity of a flowable substance from a container. A counter is provided for automatically counting the actuated strokes, the counter being started up by the actuation of the actuating pusher. A locking device is provided for the actuating stroke which can be actuated as a function of the counter. The locking means is activated after a daily maximum dose of a certain number of strokes and can then be released again.

These prior art dosing mechanisms, however, generally lack the ability providing for a specified number of strokes for dosage control prior to being automatically reset after the final stroke. For example, the user may require three strokes of nasal medicant per nostril such that after the end of the third stroke the dispenser is rendered child proof until the operator restarts the device. The known prior art dispensers having a dosage or metering control are incapable of achieving a specified control of designated strokes.

SUMMARY OF THE INVENTION

It is therefore an object of the present invention to provide a dispenser having a dosage control mechanism which provides for a specified number of strokes ending in automatic resetting and locking of the pumping actuator after the end of the last stroke. The dispenser with such a control according to the invention is developed as having relatively few moving parts, is easy to operate and assemble yet is highly economical.

The control ring is mounted on the dispenser body and is coupled to the plunger for rotation in only one direction from a locked position and through a plurality of predetermined cam cycles whereupon the plunger is automatically reset at a relocked position. The coupling between the control ring and the plunger converts translatory motion to rotatory motion such that the plunger is capable of only a specified number of strokes in each revolution of the control ring.

A cam on the plunger engages an abutment shelf on the control ring for locking the plunger against reciprocation before the beginning of the first stroke and after the end of the last stroke. The control ring and plunger are both freely rotatable and are rotatable relative to one another. And limit stops are provided on the shelf, one of which is overridden upon relative rotation of the ring and plunger to place the same in readiness for actuation. After the end of the last stroke the plunger is automatically locked as the cam returns to the shelf.

The coupling between the control ring and the plunger further includes a zigzag track in which the cam engages the rearward faces of track walls forming index ramps at acute and obtuse angles. The track walls have free ends which deflect and permit the cam to pass from one angular ramp to the other, thereby acting as a one-way gate for each individual cam cycle.

The need to relatively rotate the control ring to that of the plunger renders the dispenser child resistant as the relative rotation between the two parts is generally incapable of being carried out by a young child.

Other objects, advantages and novel features of the invention will become more apparent from the following detailed description of the invention when taken in conjunction with the accompanying drawings.

DETAILED DESCRIPTION OF THE DRAWINGS

FIG. 1 is a vertical sectional view of a manually actuated pump dispenser incorporating the invention;

FIG. 2 is an enlarged side elevational view of the control ring of FIG. 1;

FIG. 3 is a view taken substantially along the line 3—3 of FIG. 2;

DETAILED DESCRIPTION OF THE INVENTION

Figure 4:
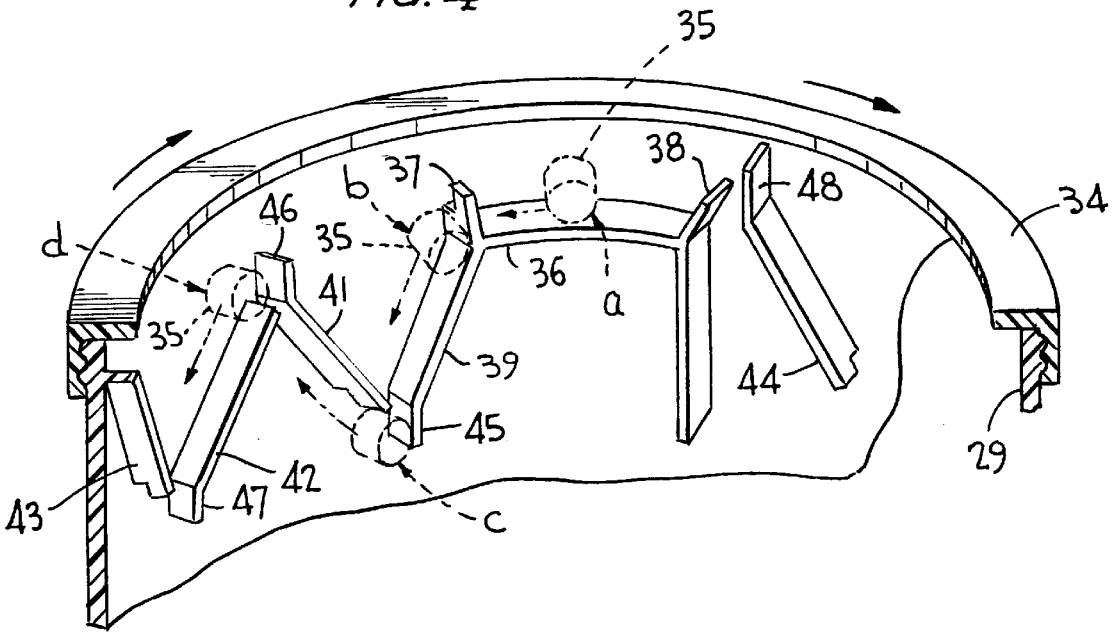
FIG. 4 is a perspective view of a portion of the control ring, at an enlarged scale, showing the sequential path of the plunger cam with which the ring is coupled.

Turning now to the drawings wherein like reference characters refer to like and corresponding parts throughout the several views, the dispenser incorporating the invention is generally designated 10 in FIG. 1 of generally known construction as disclosed in U.S. Pat. No. 4,051,983, commonly owned herewith. The entirety of the disclosure of that patent is therefore specifically incorporated herein by reference. Thus the dispenser has a pump body 11 coupled to an internally threaded closure cap 12 for mounting the dispenser to the externally threaded neck of a container C of product to be dispensed. The pump body includes a pump housing 13 having a pump cylinder portion 14 for the reception of a reciprocable pump piston 15 which therewith defines a variable volume pump chamber 16. The pump piston has a hollow stem 17 to which is fixedly mounted to a pump head 18 having a cylindrical skirt 19. The hollow stem defines a discharge passage 21 which communicates with a discharge opening 22 at the end of a discharge spout 23 or the like, through which liquid product is discharged in any normal manner as known in this art.

A three-piece poppet valve, generally designated 24, has a poppet valve part 25 seated against a valve seat formed in the pump piston, part 25 being coupled to a small diameter piston 26 which reciprocates within a small diameter cylinder 27 as an integral portion of pump housing 13. An inlet ball check valve 28 is captured between parts 25 and 26 for the inletting of product into the pump chamber during each piston suction stroke as in the known manner and as specifically described in the '983 patent. A piston return spring 20 is located in cylinder 27 and bears against the three-piece poppet for returning the piston to its FIG. 1 position.

In accordance with the invention a control ring 29 is coupled to closure cap 12 in telescoping relation to plunger skirt 19. The control ring has an external annular bead 31 (FIG. 2) engageable with an annular groove 32 (FIG. 1) in upstanding flange 33 of the closure cap permitting the control ring to freely rotate relative to the plunger and relative to the closure cap. A retainer collar 34 mounted to the upper end of the control ring may be provided for snugly embracing the plunger skirt. Otherwise, the control ring may have an integral annular collar or flange for this purpose.

According to the invention control ring 29 is coupled to cylindrical skirt 19 of the pump plunger so that the translatory movement of the plunger is converted to rotary movement of the control ring during each individual cam cycle 30 (FIG. 3). For this purpose plunger skirt 19 has a radially extending projection 35 in the form of a cam which may be of circular cross-section. The inner surface of the control ring has a horizontal shelf defined by a flat rib 36 or the like on which cam 35 rests in a given rotative orientation of the control ring. When cam 35 abuts against rib 36, the pump plunger is inactivated and cannot be depressed. In the embodiment disclosed the plunger is thus locked in its up position at the end of the piston suction stroke when cam 35 is in its "a" position of FIG. 4.

In this position manual rotation of the plunger or manual rotation of the control ring about the central axis of the dispenser will cause both parts 18 and 29 to rotate together as they are both freely rotatable about that axis. Provided at opposite ends of shelf 36 are detents forming stop elements 37 and 38 which normally confine cam 35 to shelf 36 during rotation of either the plunger head or the control ring about the central axis. The stop element 37 is deflectable such that upon relative rotation of the plunger head and the control ring (as by manually turning the plunger head and control ring in relatively opposite directions), the cam overrides stop element 37 to its "b" position of FIG. 4, thereby permitting plunger reciprocation. The dispenser is thus rendered child-resistant as a young child is unlikely able to carry out a two-handed operation by manipulating the plunger head and the control ring so as to rotate them relative to one another to thereby unlock the plunger. It should be pointed out that relative rotation causing cam 35 to shift in an opposite direction toward stop 38, does not unlock the plunger as prevented by end 48 of rib 44.

The inner wall of the control ring likewise has a zigzag track along the circumference commencing at stop element 37, extending about the entire circumference along the inner surface of the control ring, and terminating at stop element 38. The track may be comprised of a plurality of index ramps defined by ribs 39, 41, 42, 43, etc., and terminating in rib 44, alternatively at obtuse and acute angles. The control ring is rotatable about its axis only in the direction of the curved arrows of FIG. 4. Thus relative to that direction it can be seen that rib 39 slopes downwardly and rearwardly, terminating in a deflectable end 45 slightly spaced apart from the confronting end of rib 41 a distance slightly less than the diameter of cam 35. End 45 is elongated as shown in FIG. 3 to permit cam 35 on the plunger to shift as necessary through its full downstroke upon manual reciprocation.

Rib 41 slopes upwardly and rearwardly and terminates in a deflectable end 46 which is spaced a slight distance from the confronting end of rib 42 a distance slightly less than the diameter of cam 35. Rib 42 slopes downwardly and rearwardly, parallel to rib 39, terminates in a deflectable end 47 which is spaced from the confronting end of rib 43 a distance slightly less than the diameter of cam 35. Rib 43 slopes upwardly and rearwardly, parallel to rib 41, and has its upper end (not shown) terminating in a deflectable end (not shown) similar to that of end 46. Ribs such as 41 and 42 with their deflectable ends as aforedescribed continue throughout the entire circumference along the entire inner surface of the control ring and terminate in rib 44 having a deflectable end 48 which is spaced from confronting end 38 a distance slightly less than the diameter of cam 35.

In operation, the dispenser is shipped and stored and is maintained during non-use with its plunger in its up locked position in FIG. 4 immobilized against actuation as its cam 35 rests against lock shelf 36 located in its path. Any attempt by a child in this position to rotate the plunger head or the control ring about the central axis of the dispenser will effect rotation of both of these parts together as cam 35 shifts into position against either stop element 37 or against stop element 38. To place the dispenser in readiness for pumping by the user, the plunger and the control ring must be relatively rotated in opposition directions (as by holding one part and rotating the other) causing cam 35 to override end element 37 by deflecting the same whereupon the cam is shifted from its position "a" to its position "b" as illustrated in FIG. 4. Upon manual application of finger force to the top surface of the plunger head, cam 35 is guided along the rear surface of rib 39 (relative to the direction of the curved arrows of FIG. 4) until the cam reaches position "c" shown in FIG. 4. At this position the cam is forced through the space between deflectable end 45 and the confronting end of rib 41 such that the cam is guided along the rear surface throughout the length of end 45 to position "C'" (FIG. 3) during the extent of the plunger downstroke. During the return movement of the plunger the cam is guided from its "C'" position back to its "c" position at which it is now disposed at the underside of rib 41. As known in this art, piston return is effected by the resilient expansion of return spring 20 to return the piston 15 and the plunger to its initial position of FIG. 1, upon release of the finger pressure applied to the plunger. In this process cam 35 is guided along the rear surface of rib 41 and out through the spacing between end 46 and the confronting end of rib 42. The cam deflects end 46 as it moves through this space to its position shown at "d" in FIG. 4. Repeated application of finger force against the top of the head again lowers the head and the pump piston such that cam 35 is now guided along the rear surface of rib 42 and when it reaches the lower end of the rib it deflects end 47 away from the confronting end of rib 43 and is guided along the extension of end 47 through the extent of the plunger downstroke so as to be placed in a position during the return stroke in readiness to be guided along the rear surface of rib 43 as in the same manner as described above relative to rib 41. During each pressure and return stroke the plunger reciprocates and is guided along the ribs forming index ramps which thereby act as a one-way gate for each complete pressure and return stroke. As the plunger head is shifted through one reciprocation cycle, the control ring rotates about the head through a single cam cycle 30 (FIG. 3) via the fixed cam 35 on the head skirt. During continued plunger reciprocation the control ring rotates progressively through like cam cycles as the cam traverses the sets of one-way gate ramps until the cam finally ends up being guided along the underside of rib 44 during the final plunger return stroke of the series. The cam thereupon moves through the space between end 48 and stop element 38 deflecting element 48 so as to finally end up back on top of lock shelf 36 from which it started.

Thus each adjoining pair of ramps such as 39 and 41 rotates the control ring a single cam cycle 30 during a single piston pressure and return stroke. The circumferential distance 30 depends on the number of adjoining rib pairs and the slope thereof. The number of pairs of ribs such as 39 and 41 and 42, 43 around the inner circumference of the control ring determines the number of pressure strokes the designed for the dispenser before the plunger automatically resets itself after the final stroke such as by ending back up on the shelf at position "a". The dosage through a predetermined number of cam cycles of the control ring is therefore limited with the plunger being automatically reset back to its locked and child resistant position after the final stroke. Thus if four pressure strokes, for example, are determined for a throat spray, the control ring 29 will be designed with four pairs of ramps such as 39, 41. The number of pressure strokes intended for dosage control in accordance with the invention of course depends on the number of ramp pairs which, in order to extend the ramp pairs from one end 37 of shelf 36 throughout the circumference of the control ring and ending back at the opposite end 38, requires the slope of the ramp pairs to be adjusted accordingly.

Another child-resistant feature which may be provided for the dispenser comprises an overcap 49 surrounding closure cap 12. The overcap is freely rotatable about the closure cap axis. Cooperating snap beads 51 and 52 on the overcap and on the closure cap permit a snap-fit mounting of the overcap in place. One-way internal ratchet teeth 53 at the upper end of the overcap may be provided as in any known manner for engagement with like ratchet teeth 54 on the closure cap permitting engagement between the two sets of ratchet teeth in the loosening direction of the closure cap. Thus the dispenser is removable from its container upon the application of a slight downward force applied to the overcap causing the ratchet teeth sets 53, 54 to interengage, while rotating the overcap in a loosening direction. It is apparent that a young child is incapable of such a two-step operation, thereby further rendering the dispenser child-resistant.

Figure 5:
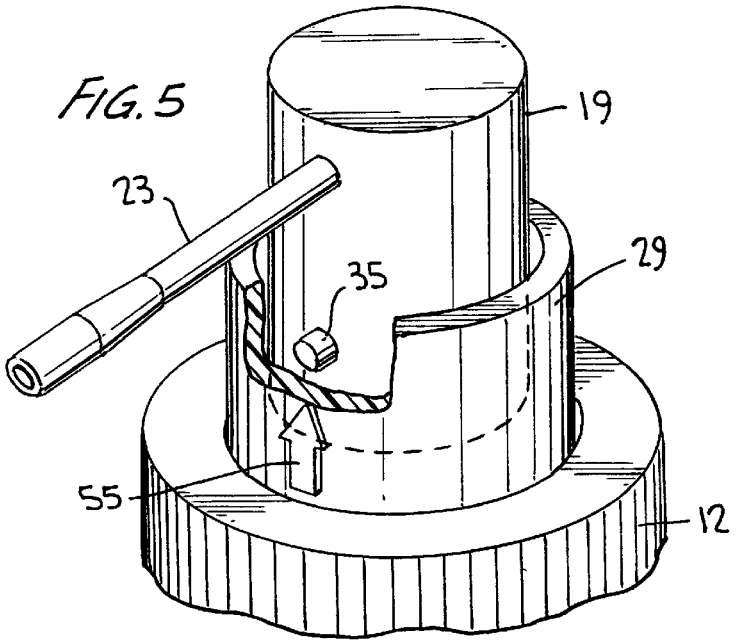
FIG. 5 is a perspective view of the FIG. 1 dispenser, partly broken away to illustrate the plunger head cam.

As shown in FIG. 5, discharge spout 23 is generally aligned with cam 35, and an indicating arrow 55 is provided on the outer surface of control ring 29 indicating that the plunger head is in a locked position with cam 35 in its position "a" of FIG. 4.

Although the guide track for the cam has been aforedescribed as extending about the inner circumference of the control ring, it should be pointed out that two complete guide tracks may be provided, each extending along a portion of the inner circumference of the control ring and each being identical. Each track would function in the identical manner as aforedescribed as each having a lock shelf 36, and ribs 39, 41, etc. The other plunger locked position may therefore be indicated by a indicating arrow 56 (FIG. 2) applied to the outer surface of the control ring.

Obviously, many modifications and variations of the present invention are made possible in the light of the above teachings. For example the track from the inner circumference of the control ring can be formed by grooves in the surface of the control ring rather than by the provision of ribs such as 39, 41, without departing from the invention. Also cam 35 can be freely rotatable or can be of any other shape or form so long as it functions to convert the translatory motion of the plunger to the rotational movement of the control ring as it is guided about the track or tracks as in the manner aforedescribed for controlling the dosage of the dispenser. Moreover, the pump sprayer as aforedescribed is not required for carrying out the invention. Any other known pump sprayer can be adopted without departing from the scope of the invention. It is therefore to be understood that within the scope of the appended claims the invention may be practiced otherwise than as specifically described.

I claim:

1. A dispenser having a plunger manually reciprocable through a central opening in a closure cap of a container of product to be dispensed, a control ring rotatably mounted on said closure cap in only one direction, cam means on said plunger engageable with abutment means on said control ring for selectively locking said plunger in an initial set position, and means on said control ring engageable with said cam means during plunger reciprocation in a plunger unlocked position for converting translatory motion of said plunger to rotary motion of said control ring in said one direction, said converting means comprising one way gate means establishing individual cam cycles for each reciprocating movement of the plunger causing said control ring to sequentially rotate from said unlocked position through a cycle of rotary motion and to be automatically reset to said locked position.

2. The pump sprayer according to claim 1, wherein a detent at said abutment means defines a limit stop for said cam means, relative manual rotation between said plunger and said ring acting to override said limit stop into said plunger unlocked position.

3. The pump sprayer according to claim 1, wherein said converting means comprise zigzag links for guiding said cam means only along rear faces of said links.

4. The pump sprayer according to claim 3, wherein pairs of said links are angularly related and are spaced apart to facilitate the guiding of said cam means only along said rear faces through said individual cam cycles.

5. The pump sprayer according to claim 1, wherein said cam means comprises a lateral projection on said plunger.

6. The pump sprayer according to claim 5, wherein said abutment means comprises an abutment wall in alignment with said lateral projection in said locked position.

7. A pump dispenser, comprising a pump body having means for mounting the body to a container of liquid product to be dispensed, the dispenser being manually reciprocable between pressure and return strokes, a control ring mounted on said body for rotation about a central axis of said plunger, said ring being coupled to said plunger by a plurality of index ramps for controlling the number of pressure strokes and thereby the dosage of the dispenser for a cycle of revolution of the control ring, and means acting between said ring and said plunger for locking said plunger against reciprocation at the commencement and at the end of each said cycle of revolution of the control ring.

8. The pump dispenser according to claim 7, wherein said locking means comprise a cam on said plunger and an abutment wall on said ring.

9. The pump dispenser according to claim 8, wherein said index ramps comprise a plurality of contiguous angularly related rib pairs having deflectable ends permitting said cam to pass therethrough, said rib pairs acting as one-way gates for each complete pressure and return stroke.

10. The pump dispenser according to claim 9, wherein said abutment wall has a detent at said one end for confining said cam to said wall, said ring being manually rotatable in a forward direction relative to said plunger for overriding said detent.

11. The pump dispenser according to claim 8, wherein said control ring has indicia on an outer surface thereof in alignment with said cam for indicating a locked position of said plunger.

* * * * *